US006484819B1

(12) United States Patent
Harrison

(10) Patent No.: US 6,484,819 B1
(45) Date of Patent: Nov. 26, 2002

(54) DIRECTIONAL BOREHOLE DRILLING SYSTEM AND METHOD

(76) Inventor: William H. Harrison, 7280 Hyannis Dr., West Hills, CA (US) 91307

( * ) Notice: Subject to any disclaimer, the term of this patent is extended or adjusted under 35 U.S.C. 154(b) by 0 days.

(21) Appl. No.: 09/679,180

(22) Filed: Oct. 4, 2000

Related U.S. Application Data

(60) Provisional application No. 60/165,967, filed on Nov. 17, 1999.

(51) Int. Cl.[7] ..... E21B 7/04; E21B 10/20; E21B 44/00; E21B 47/02

(52) U.S. Cl. ..... 175/61; 166/66; 175/26; 175/45; 175/73; 175/279

(58) Field of Search ..... 175/279, 331, 175/342, 61, 73, 40, 45, 273, 24, 26; 166/250.01, 66, 50, 313

(56) References Cited

U.S. PATENT DOCUMENTS

| | | | | | |
|---|---|---|---|---|---|
| 3,825,081 | A | * | 7/1974 | McMahon | 175/325.2 |
| 4,040,003 | A | * | 8/1977 | Beynet et al. | 175/40 |
| 4,491,186 | A | * | 1/1985 | Alder | 173/9 |
| 5,160,925 | A | * | 11/1992 | Dailey et al. | 175/40 |
| 5,314,030 | A | * | 5/1994 | Peterson et al. | 175/26 |
| 5,341,886 | A | * | 8/1994 | Patton | 175/24 |
| 5,467,832 | A | * | 11/1995 | Orban et al. | 175/45 |
| 5,813,480 | A | * | 9/1998 | Zaleski et al. | 175/40 |
| 5,880,680 | A | * | 3/1999 | Wisehart et al. | 175/26 |
| 6,109,370 | A | * | 8/2000 | Gray | 175/215 |
| 6,230,822 | B1 | * | 5/2001 | Sullivan et al. | 175/228 |

FOREIGN PATENT DOCUMENTS

| | | | | |
|---|---|---|---|---|
| DE | 3704077 A1 | * | 8/1987 | E21B/44/00 |
| WO | WO 93/12319 | * | 6/1993 | E21B/7/04 |

* cited by examiner

*Primary Examiner*—David Bagnell
*Assistant Examiner*—Jennifer H Gay
(74) *Attorney, Agent, or Firm*—Koppel, Jacobs, Patrick & Heybl

(57) ABSTRACT

A directional borehole drilling system employs a controllable drill bit, which includes one or more drilling surfaces which are dynamically positionable in response to respective command signals. Instrumentation located near the bit measures present position when the bit is static, dynamic and drilling surface position information when the bit is rotating, and stores a desired trajectory. This data is processed to determine the error between the present position and the desired trajectory, and the position of one or more of the bit's drilling surfaces is automatically changed as needed to make the bit dig in the direction necessary to reduce the error. The controllable drill bit preferably comprises three cone assemblies mounted about the bit's central axis, each of which includes a cone and an eccentric cam that rotate about a common axle. In response to a command signal, the cam is locked to the cone to cause concentric rotation of the cone, or locked to the axle to cause eccentric rotation of the cone—which causes the bit to dig in a preferred direction.

29 Claims, 9 Drawing Sheets

CONCENTRIC MODE

ECCENTRIC MODE

DIRECTIONAL BOREHOLE DRILLING SYSTEM AND METHOD

This application claims the benefit of provisional patent application No. 60/165,967 to Harrison, filed Nov. 17, 1999.

BACKGROUND OF THE INVENTION

1. Field of the Invention

This invention relates to the field of borehole drilling, and particularly to systems and methods for controlling the direction of such drilling.

2. Description of the Related Art

Boreholes are drilled into the earth in the petroleum, gas, mining and construction industries. Drilling is accomplished by rotating a drill bit mounted to the end of a "drill string"; i.e., lengths of pipe that are assembled end-to-end between the drill bit and the earth's surface. The drill bit is typically made from three toothed cone-shaped structures mounted about a central bit axis, with each cone rotating about a respective axle. The drill bit is rotated about its central axis by either rotating the entire drill string, or by powering a "mud motor" coupled to the bit at the bottom end of the drill string. The cones are forced against the bottom of the borehole by the weight of the drill string, such that, as they rotate about their respective axles, they shatter the rock and thus "dig" as the drill string is turned.

Boreholes are frequently drilled toward a particular target, and thus is it necessary to repeatedly determine the drill bit's position. This is typically ascertained by placing an array of accelerometers and magnetometers near the bit, which measure the earth's gravity and magnetic fields, respectively. The outputs of these sensors are conveyed to the earth's surface and processed. From successive measurements made as the borehole is drilled, the bit's "present position" (PP) in three dimensions is determined.

Reaching a predetermined target requires the ability to control the direction of the drilling. This is often accomplished using a mud motor having a housing which is slightly bent, so that the drill bit is pointed in a direction which is not aligned with the drill string. To effect a change of direction, the driller first rotates the drill string such that the bend of the motor is oriented at a specific "toolface" angle (measured in a plane orthogonal to the plane containing the gravity vector (for "gravity toolface") or earth magnetic vector (for "magnetic toolface") and the motor's longitudinal axis). When power is applied to the motor, a curved path is drilled in the plane containing the longitudinal axes.

One drawback of this approach is known as "drill string wind-up". As the mud motor attempts to rotate the drill bit in a clockwise direction, reaction torque causes the drill string to tend to rotate counter-clockwise, thus altering the toolface away from the desired direction. The driller must constantly observe the present toolface angle information, and apply additional clockwise rotation to the drill string to compensate for the reaction torque and to re-orient the motor to the desired toolface angle. This trial and error method results in numerous "dog leg" corrections being needed to follow a desired trajectory, which produces a choppy borehole and slows the drilling rate. Furthermore, the method requires the use of a mud motor, which, due to the hostile conditions under which it operates, must often be pulled and replaced.

SUMMARY OF THE INVENTION

A system and method of drilling directional boreholes are presented which overcome the problems noted above. The invention enables a desired drilling trajectory to be closely followed, so that smoother boreholes are produced at a higher rate of penetration.

The invention employs a controllable drill bit, which includes one or more drilling surfaces which are dynamically positionable in response to respective command signals. Instrumentation located near the bit measures present position when the bit is static, dynamic toolface and drilling surface position information when the bit is rotating, and stores a desired trajectory. This data is processed to determine the error between the present position and the desired trajectory, and the position of one or more of the bit's drilling surfaces is automatically changed as needed to make the bit dig in the direction necessary to reduce the error.

The controllable drill bit is preferably made from three cone assemblies, each of which includes a cone and an eccentric cam that rotate about a common axis. In response to a command signal, the cam is either locked to the cone to cause concentric rotation of the cone, or locked to the axle to cause eccentric rotation of the cone—which causes the bit to dig in a preferred direction.

Further features and advantages of the invention will be apparent to those skilled in the art from the following detailed description, taken together with the accompanying drawings.

DETAILED DESCRIPTION OF THE INVENTION

Borehole drilling is typically performed using a drill bit mounted to the bottom of a drill string made from lengths of pipe that are successively added end-to-end as the bit digs deeper into the earth. To dig, the drill bit is rotated about a central axis, either by rotating the entire drill string (from the end of the string at the earth's surface), or with the use of a motor coupled directly to the drill bit. The drill bit typically includes a number of drilling surfaces which rotate and dig into the earth as the bit is rotated.

The present directional borehole drilling system requires the use of a "controllable" drill bit. As used herein, a controllable drill bit includes one or more drilling surfaces which are dynamically positionable in response to respective command signals. A drilling surface is "positionable" if, for example, the toolface angle at which it digs can be dynamically changed. This capability enables the drill bit to preferentially dig in a desired direction, making the borehole drilling system to which the bit is attached directional.

Figure 1:
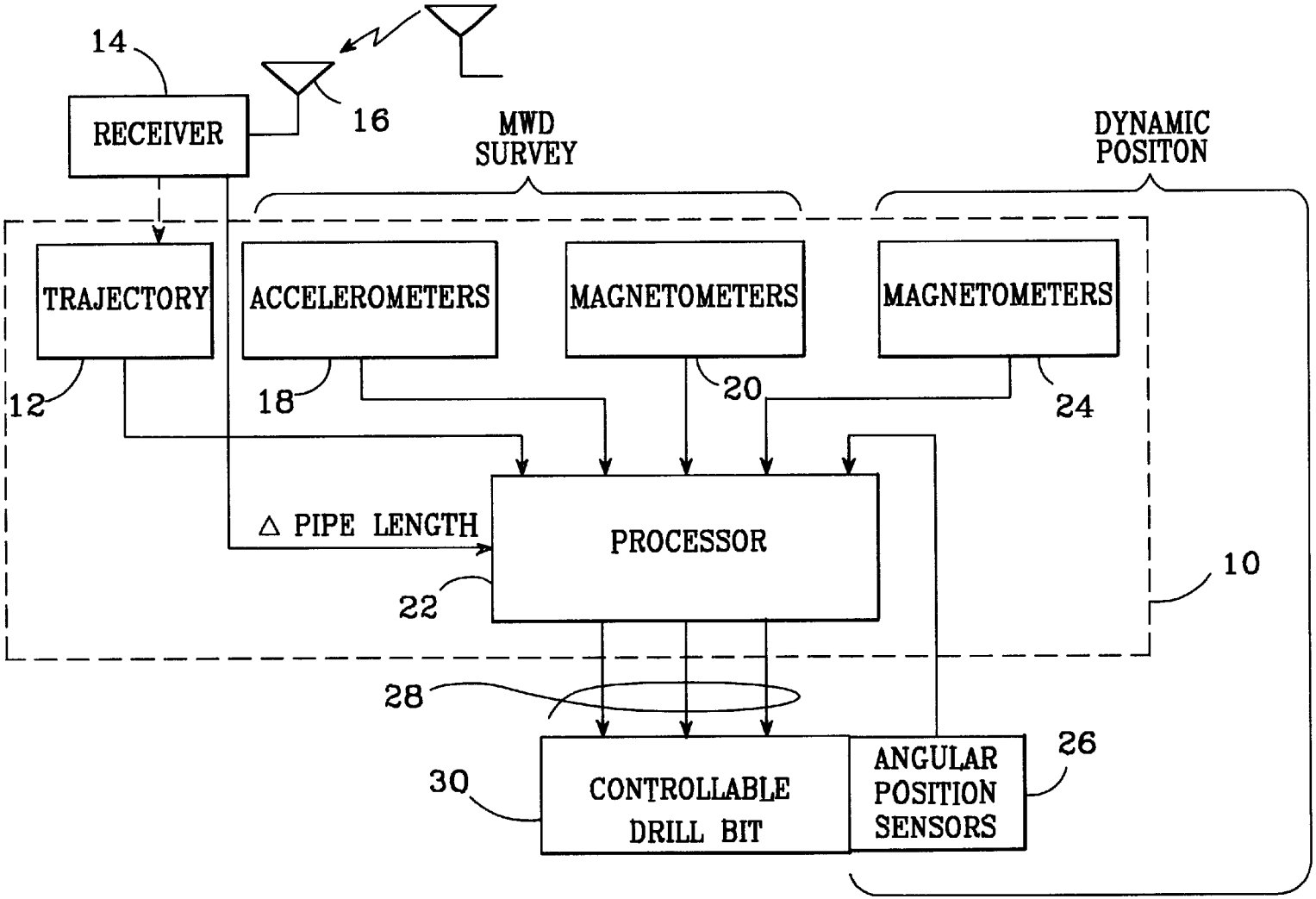
FIG. 1 is a block diagram illustrating the basic principles of the invention.

The basic elements of the directional borehole drilling system are shown in FIG. 1. A "control sonde" 10, i.e., an instrumentation and electronics package which is physically located near the drill bit, is used to generate the command signals needed to achieve directional drilling. The sonde includes a storage medium 12, which may be semiconductor or magnetic memory, for example, which retains information representing a desired trajectory for the drill bit. The desired trajectory is generally determined before drilling is started. The trajectory can be loaded into the storage medium is one of several ways: for example, it can be preloaded, or it can be conveyed to the sonde from the surface via a wireless communications link, in which case the sonde includes a receiver 14 and antenna 16.

To guide the bit along the desired trajectory, it is necessary to know its present position in the coordinate system in which the trajectory is plotted. Control sonde includes instrumentation which is used to determine present position while the bit is static, as well as to determine the bit's toolface angle and the positions of the drilling surfaces when the bit is rotating. Instrumentation for determining present position typically includes a triad of accelerometers 18 and a triad of flux-gate magnetometers 20, which measure the earth's gravity and magnetic fields, respectively. The outputs of these sensors are fed to a processor 22, which also receives information related to the lengths of pipe (Δ PIPE LENGTH) being added to the drill string, and the stored trajectory information. Pipe length information is typically provided from the surface via a communications link such as receiver 14 and antenna 16. Data from these sources is evaluated each time the bit stops rotating, enabling the present position of the control sonde, and thus of the nearby drill bit, to be determined in three dimensions. Determination of a drill bit's present position in this way is known, and is commonly referred to as performing a "measurement-while-drilling" (MWD) survey.

Control sonde 10 also includes instrumentation for determining the bit's toolface angle and the positions of the positionable drilling surfaces when the bit is rotating. Such "dynamic" instrumentation would typically include an additional dyad of magnetometers 24 which can be used to determine magnetic toolface information as the bit is rotating. Other data, such as the outputs from a set of angular position sensors 26 which pulse as respective drilling surfaces rotate past pre-defined index points, are also be fed to processor 22.

Having received the stored trajectory, present position, and drilling surface position information, processor 22 determines the error between the present position and the desired trajectory. Processor 22 then provides command signals 28 to a controllable drill bit 30 which causes the bit to bore in the direction necessary to reduce the error.

By dynamically altering the positions of one or more drilling surfaces to preferentially dig in a direction necessary to reduce the error, the trajectory of the borehole is made to automatically converge with the desired trajectory. Because the trajectory corrections are made dynamically, they tend to be smaller than they would be if made manually. As a result, the system spends most of its time drilling a straight hole, with minor trajectory corrections made as needed. The dynamic corrections enable the present invention to require fewer and smaller "dog leg" corrections than prior art systems, so that a smoother borehole provides a higher rate of penetration (ROP), as well as other benefits that result from a low dog leg borehole.

Figure 2:
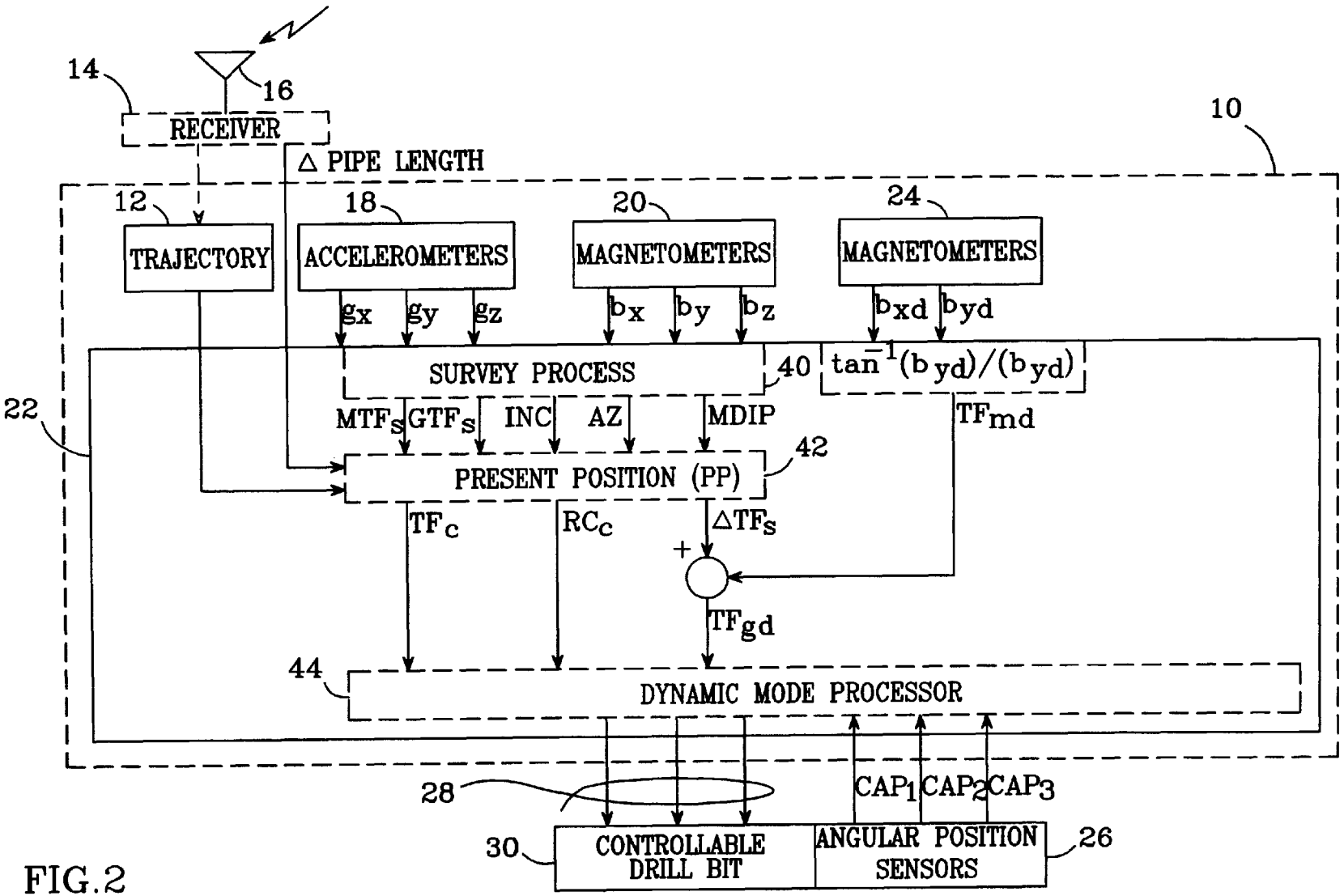
FIG. 2 is a more detailed block diagram of a directional borehole drilling system per the present invention.

A more detailed diagram of the present invention is shown in FIG. 2. Processor 22 may be implemented with several sub-processors or discrete processors. Accelerometers 18 sense acceleration and produce outputs $g_x$, $g_y$ and $g_z$, while magnetometers 20 sense the earth's magnetic field vectors to produce outputs $b_x$, $b_y$ and $b_z$, all of which are fed to a "survey process" processor 40. Processor 40 processes these inputs whenever the drill bit is static, calculating magnetic toolface ($MTF_S$) and gravity toolface ($GTF_S$) (defined above), as well as the bit's inclination (INC), azimuth (AZ), and magnetic dip angle (MDIP). These values are passed onto a "present position processor" 42. The offset angle relationships between the sensors and the drill bit are known; processor 42 combines this information with the above parameters and the Δ PIPE LENGTH data to determine the bit's present position (PP).

Present position processor 42 also receives the desired trajectory from storage medium 12, and compares it with PP to determine the error. Processor 42 then specifies a toolface steering command ($TF_C$) and radius of curvature command ($RC_C$) needed to reduce the error. The difference between gravity toolface $GTF_S$ and magnetic toolface $MTF_S$ changes as functions of inclination INC and azimuth AZ, both of which are changing as the sonde moves along a curved path; processor 42 thus calculates $GTF_S - MTF_5$, and provides the difference $\Delta TF_S$ as an output.

In conventional borehole drilling systems, a drill operator would be provided the PP and desired trajectory information. From this data, he would manually determine how to reduce the error, and then take the mechanical steps necessary to do so. This cumbersome and time-consuming process is entirely automated here. The toolface steering command $TF_C$ and radius of curvature comand $RC_C$ are provided to a "dynamic mode" processor 44. Processor 44 also receives several dynamic inputs. A dyad of magnetometers 24 provide outputs $b_{xd}$ and $b_{yd}$ to processor 22, which provide magnetic toolface information as the bit is rotating. The value $\tan^{-1}(b_{yd}/b_{xd})$ ($=TF_{md}$) is calculated and summed with $\Delta TF_s$ to provide the real-time magnetic toolface angle $TF_{gd}$ at the bit to processor 44. Also provided to processor 44 are the outputs $CAP_1$, $CAP_2$, and $CAP_3$ of sensors 26; each sensor outputs a pulse when its respective drilling surface rotates past a predefined index point.

Dynamic mode processor 44 receives the inputs identified above and generates the command signals 28 to controllable drill bit 30, with each command signal controlling a respective positionable drilling surface. If the $TF_C$ and $RF_C$ inputs indicate that a change of direction is needed, processor 44 uses the $TF_{gd}$, $CAP_1$, $CAP_2$, and $CAP_3$ inputs to determine the positions of the drilling surfaces and to issue the appropriate commands to controllable drill bit 30 to cause the bit to dig in the desired direction.

Figure 3:
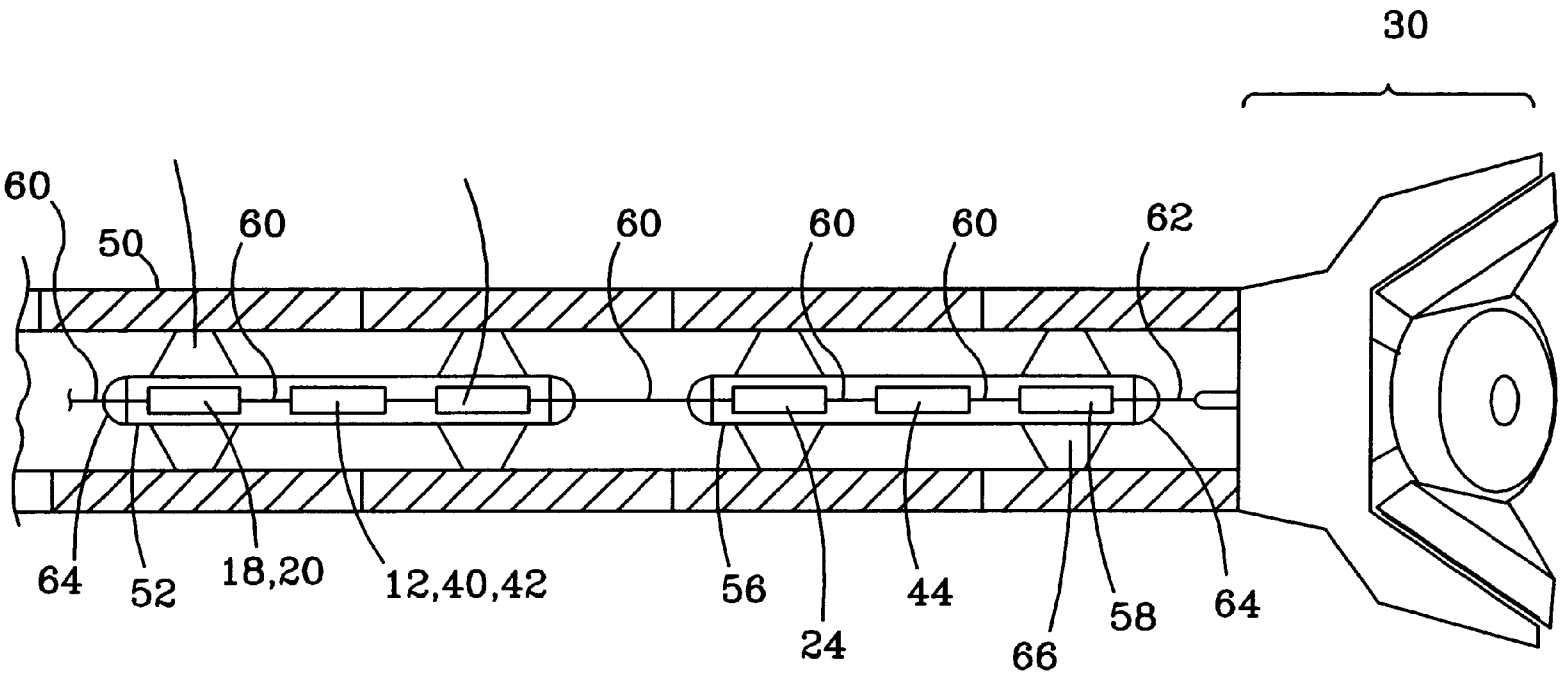
FIG. 3 is a partially cutaway view of a drill string, control sonde, and controllable drill bit.

Note that the block diagram shown in FIG. 2 is not meant to imply that all processors and instrumentation are grouped into a single package. Control sonde 10 may consist of two or more physically separated sondes, each of which houses respective instrumentation packages, and processor 22 may consist of two or more physically separated processors. One possible embodiment which illustrates this is shown in FIG. 3, which shows a cutaway view of the bottom end of a drill string 50. A first sonde 52 might contain all the "present position" equipment, such as accelerometers 18, magnetometers 20, storage medium 12 and processors 40 and 42, all powered with a battery 54; this is the functional equivalent of an MWD system. A second sonde 56 might contain all the "dynamic" equipment, such as magnetometers 24 and processor 44, powered with a battery 58. Cables 60 interconnect the separate sondes, and a cable 62 carries command signals 28 and position signals $CAP_1$, $CAP_2$, and $CAP_3$ between dynamic mode processor 44 and controllable drill bit 30. Each of the sondes house their instrumentation within protective enclosures 64, and typically include spacers or centralizers 66 which keep the sondes in the center of the drill string. Note that the instrumentation and processors may be packaged in numerous ways, including an embodiment in which all of the electronics are combined into a single sonde which uses a single battery.

Magnetometers 20 and 24 might share a common set of sensors, but are preferably separate sets. The magnetometers 20 used to determine present position preferably have high accuracy and low bandwidth characteristics, while those used to determine dynamic position (24) can have lower accuracy but need higher bandwidth characteristics. This may be accomplished using sensors that are all of the same basic type, but which have processing circuits (e.g., A/D converters, not shown) having different characteristics.

Angular position sensors 26 need not be limited to devices that pulse only when their corresponding drilling surfaces rotate past respective index points. For example, an optical encoder or a synchro could be employed to track drilling surface position.

The dynamic position instrumentation may include more than just magnetometers 24 and angular position sensors 26. When magnetometers 24 are directly in alignment with the earth magnetic field, their outputs go to zero. To circumvent this eventuality, a set of accelerometer sensors can be added to the dynamic instrumentation; these sensors can provide additional dynamic position information when filtered with, for example, a rate gyro.

Figure 4A:
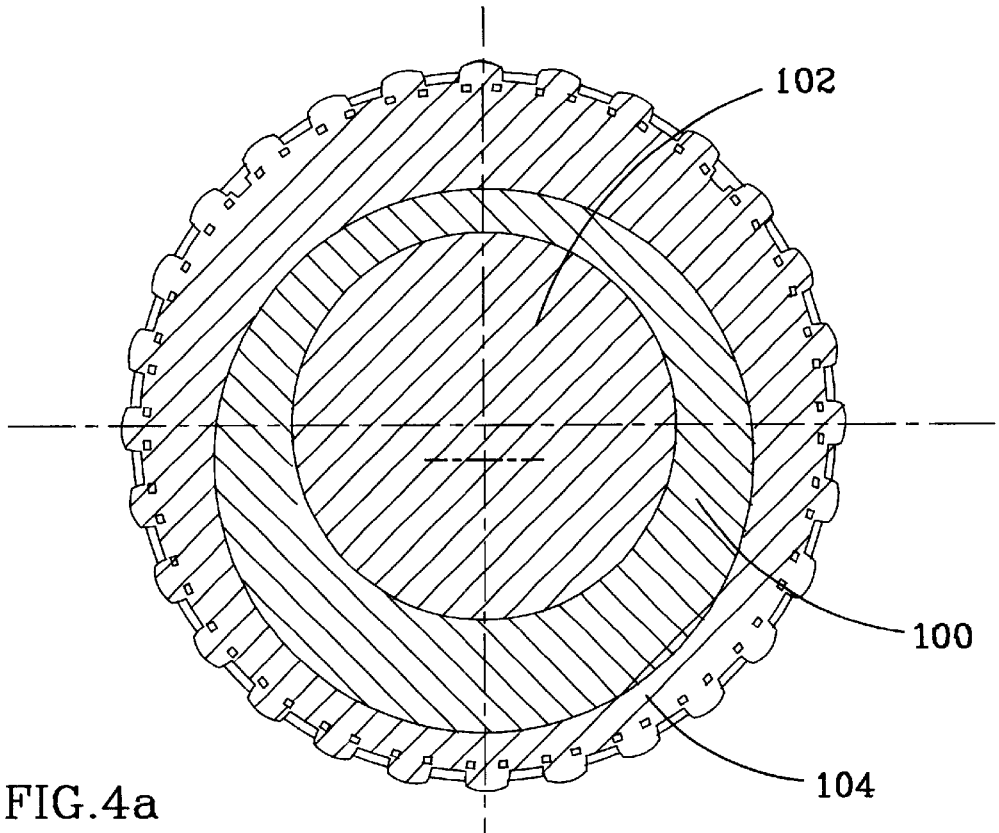
FIGS. 4*a* and 4*b* are diagrams illustrating the relationships between the cam and cone of a controllable drill bit when operating in its concentric and eccentric operating modes, respectively.
Figure 4B:
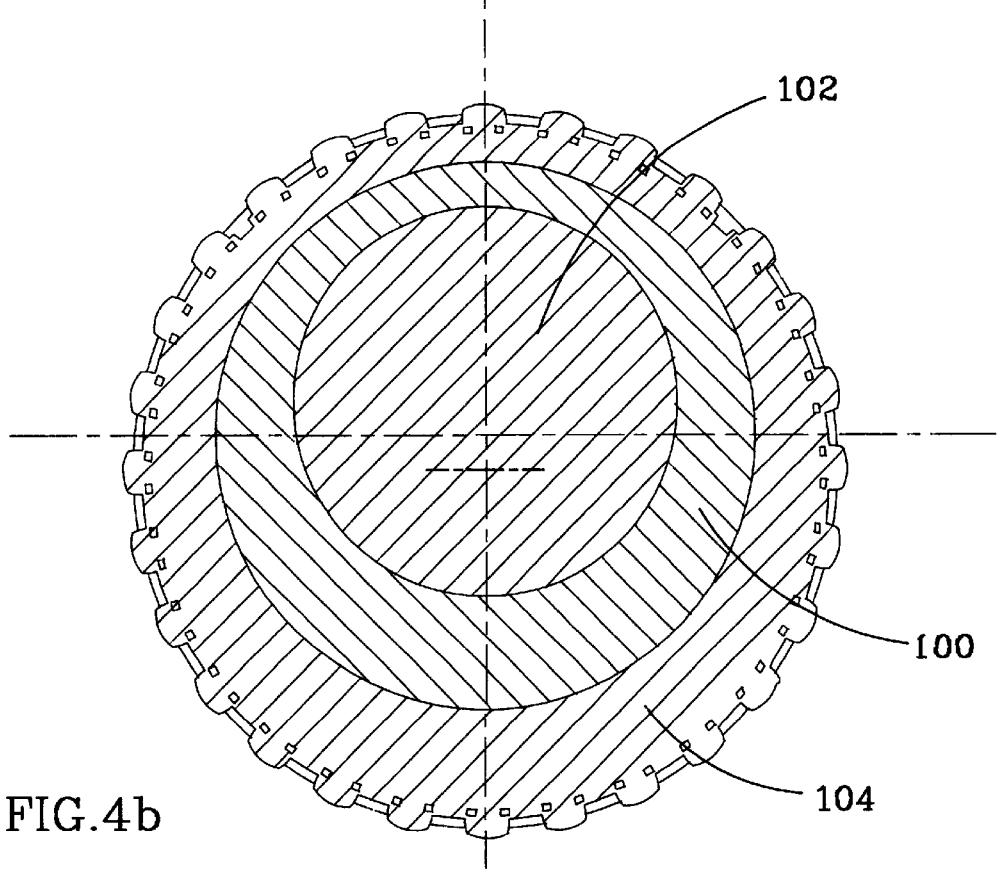

Controllable drill bit 30 may be implemented in numerous ways. A preferred bit 30 is made from three cone assemblies which rotate about respective axles mounted about a central axis. To make the bit controllable, at least one of the cone assemblies includes a mechanism that enables it to rotate eccentrically or concentrically about its axle in response to a command signal from processor 44. Eccentric rotation is preferably achieved by adding an eccentric cam to each cone assembly; one such cam/cone assembly is shown in FIGS. 4*a* and 4*b*, which are sectional views as viewed from the end of the cone. An eccentric cam 100 is placed between the axle 102 and the toothed cone 104. Bit 30 is arranged so that cam 100 can be locked to either cone 104 or axle 102. In FIG. 4*a*, cam 100 is locked to cone 104, so that the cam and cone rotate as a unit around axle 102. This results in cone 104 rotating concentrically about axle 102. In FIG. 4*b*, cam 100 is locked to axle 102, so that cone 104 must rotate about the eccentric cam. This causes cone 104 to rotate eccentrically.

Figure 5A:
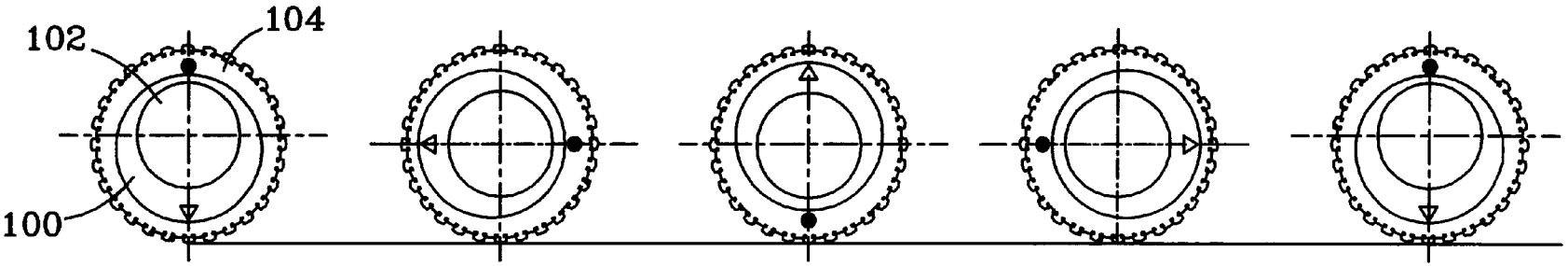
FIG. 5 is a diagram which further illustrates the operation of the cam and cone of a controllable drill bit when operating in its concentric and eccentric operating modes.
Figure 5B:
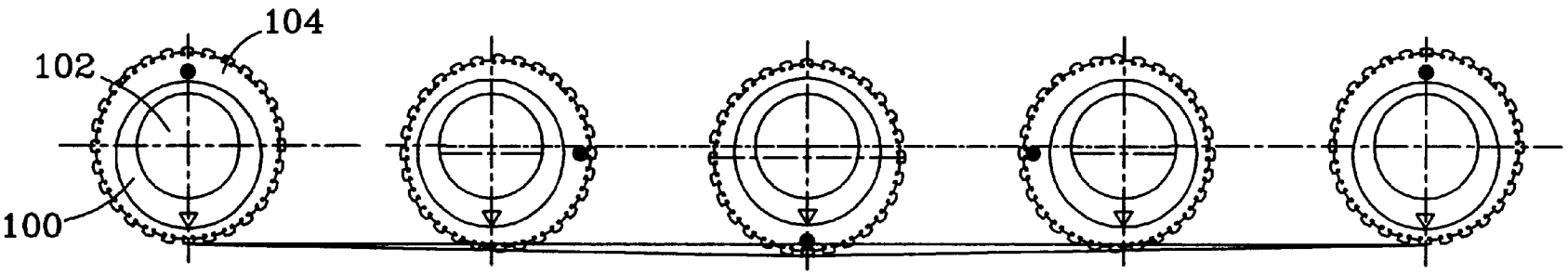

FIG. 5 illustrates one complete rotation of cone 104 for both the concentric and eccentric operating modes; the black dot on cone 104 and the triangle on cam 100 indicate fixed points on cone 104 and cam 100, respectively. In the concentric mode, cam 100 and cone 104 rotate as a unit, so that cone 104 rotates concentrically about axle 102. The concentric motion causes the cone to dig in a conventional manner. However, in the eccentric mode, eccentric cam 100 is locked to axle 102, forcing cone 104 to rotate eccentrically with respect to axle 102. As the rotating cone 104 reaches its nadir, it is extended beyond any other part of bit 30, thus increasing the stress on the rock at that toolface angle. This causes the bit to excavate more deeply, resulting in radial motion of the bit in that toolface direction. By operating a cam/cone assembly of controllable drill bit 30 in the eccentric mode and controlling the toolface angle at which the nadir occurs, the bit is made to dig in the direction necessary to reduce the error between the bit's location and the desired trajectory.

The ratio of the circumference of bit 30 to the circumference of each of cones 104 is preferably a number that is or approaches an irrational number. This prevents the nadir of an eccentrically rotating cone from repeatedly occurring at a given bit dynamic toolface angle, and ensures that a plot of cone nadir points versus bit dynamic toolface approaches a uniform distribution.

Cam 100 is preferably locked to cone 104 at the completion of a single revolution of the cone in the eccentric mode. This causes cone 104 to rotate concentrically until commanded to return to the eccentric mode by processor 44.

Figure 6:
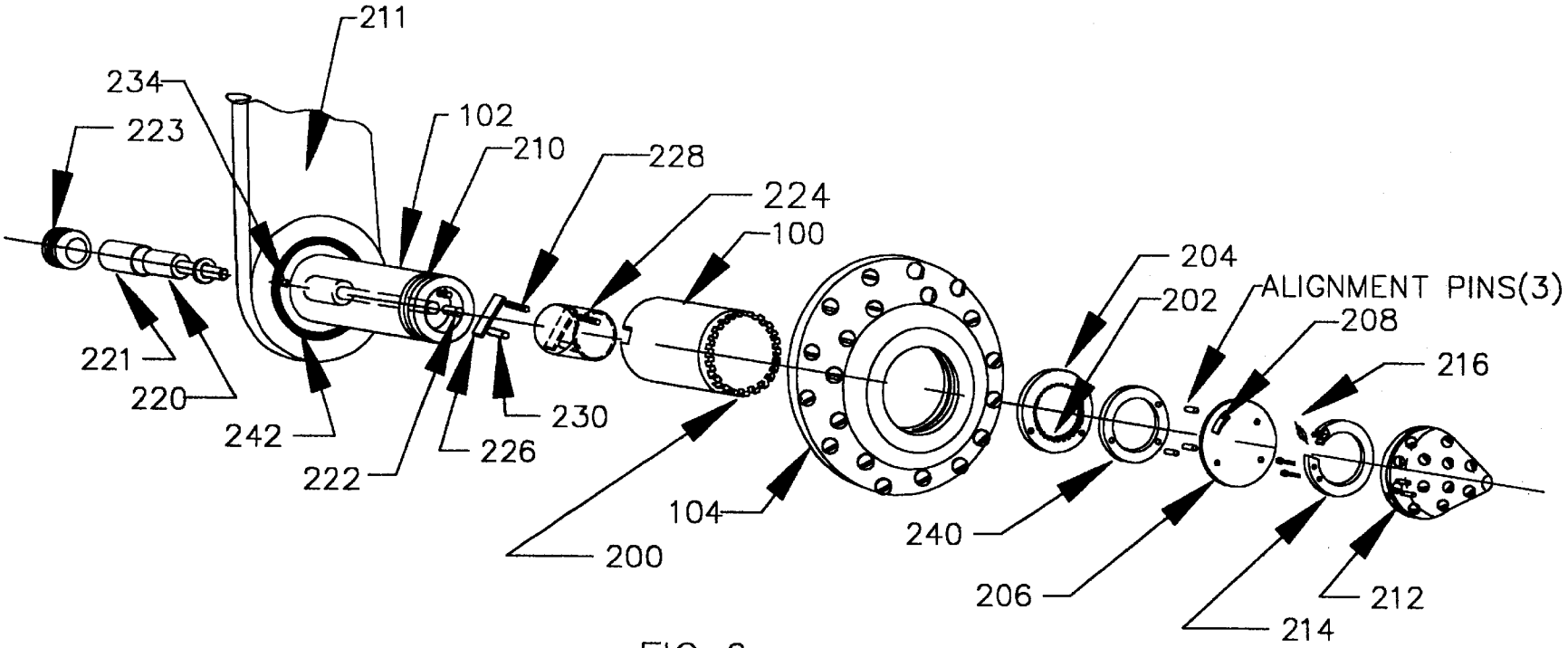
FIG. 6 is an exploded view of one possible embodiment of a controllable drill bit per the present invention.
Figure 7:
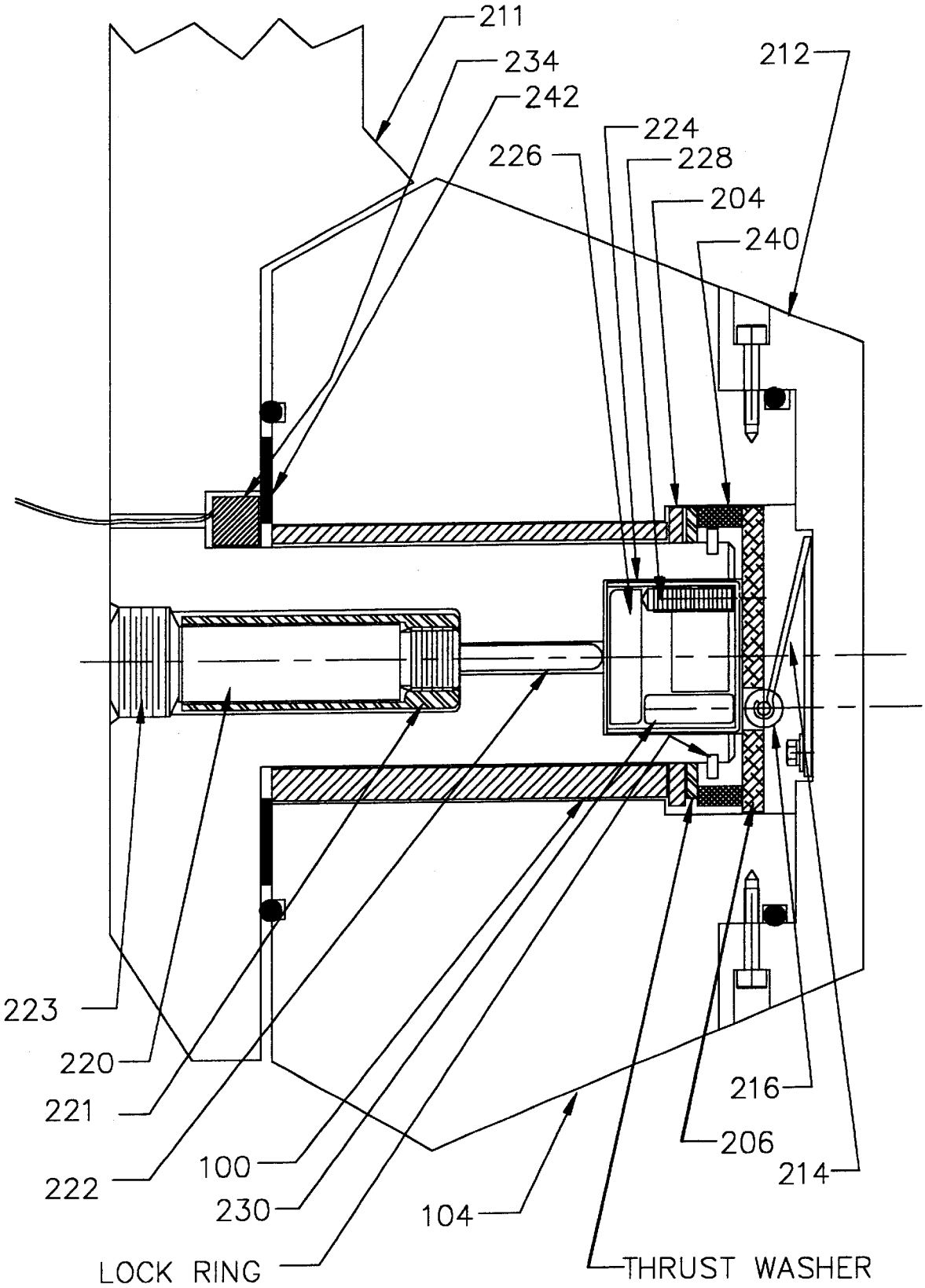
FIG. 7 is a sectional view of the controllable drill bit shown in FIG. 6.

A controllable drill bit 30 as described above includes a mechanism capable of locking cam 100 to axle 102 or cone 104 in response to a command received from processor 44. One possible embodiment of a cam/cone assembly as might be used in such a bit is shown in FIGS. 6 and 7, which are exploded and sectional views of the assembly, respectively. Here, eccentric cam 100 has a set of teeth 200 at one end which mesh with a corresponding set of teeth 202 located on the inner perimeter of a doughnut-shaped cam coupler plate 204. Cam coupler plate 204 is also coupled to a circular pawl engagement plate 206, which contains a semi-circular slot 208 near its outer diameter. Cam 100, coupler plate 204, pawl engagement plate 206, and cone 104 are mounted on axle 102, and held in place with a retaining ring (not shown in FIG. 6) which fits into a corresponding groove 210 on axle 102. Axle 102 extends from one leg 211 of the drill bit.

A semi-circular spring 214 is attached to a cap 212, which is retained in a recessed diameter on the small end of cone 104 by radial set screws. A pawl reset roller 216 is retained by a slot in semi-circular spring 214, and the roller is positioned such that it aligns with slot 208.

The cam/cone assembly also includes a solenoid 220 mounted within a sleeve 221, which is in turn mounted within and along the longitudinal axis of cylindrical axle 102; the solenoid extends a push rod 222 in response to a command signal. A plug 223 preferably fills one end of the sleeve to prevent contamination of the solenoid. A housing 224 is affixed to axle 102 and fits within cam 100, and contains a lever 226 having an adjustment screw 228 at one end and a pawl 230 at the other end. Lever 226 is aligned with push rod 222 so that, when push rod 222 is extended, pawl 230 is pushed through an opening in housing 224 and into semi-circular slot 208. Housing 224 and its contents are affixed to axle 102, and thus do not rotate with cam 100 or cone 104.

Controllable bit 30 is driven to rotate about its central axis, which in turn causes cone 104 to rotate about axle 102 by virtue of its contact with the bottom of the borehole. When cone 104 is to rotate concentrically, push rod 222 is retracted and roller 216 is in slot 208. Spring 214 applies enough pressure on roller 216 to cause cam 100 to be dragged along with cone 104 as the cone rotates. In this way, cam and cone are "locked" together as a unit which rotates concentrically about axle 102.

Eccentric rotation is triggered by actuating solenoid so that push rod 222 is extended, which pushes pawl 230 into slot 208. Slot 208 (and thus cam 100) will rotate with cone 104 until the trailing edge of the slot contacts pawl 230. As this point, pawl 230 prevents the further rotation of pawl engagement plate 206; as plate 206 is coupled to cam 100, pawl 230 effectively locks cam 100 to axle 102. Cone 104, however, continues to rotate with bit 30, due to the weight bearing upon the bit by the drill string. The continued rotation of cone 104 forces roller 216 to climb out of now-stationary slot 208, which in turn forces the cone to rotate about the locked eccentric cam. This results in the cone rotating eccentrically about axle 102.

Controllable bit 30 preferably includes three cone assemblies, each of which can be commanded to rotate eccentrically. With the ratio of the circumference of the cone to the circumference of the bit being or approaching an irrational number, each cone will frequently be in a range where it may be used to dig in the direction necessary to reduce the trajectory error. One method by which a decision may be made as to whether the solenoid of a particular cone assembly should be actuated is as follows: as noted above, each cone assembly preferably includes an angular position sensor 234 which pulses its CAP output when the cam rotates past the sensor's position. Each time processor 44 receives a CAP output, its program logic will 1) examine the toolface steering command $TF_C$ and radius of curvature comand $RC_C$ to see if a digging direction correction is needed now, and 2) examine the current dynamic magnetic toolface to see if digging at the present angle is needed. If both conditions are met, the solenoid of that particular cone assembly is actuated to trigger eccentric rotation of the cone.

Solenoid 220 need only be actuated until pawl 230 comes into contact with the trailing edge of slot 208 (which would typically occur within several milliseconds), after which mechanical forces hold the pawl in the slot. Once solenoid 220 is no longer needed, it is de-actuated, which allows push rod 222 to retract when pushed. As the cone/cap/spring assembly completes one eccentric rotation around the locked cam 100, the roller 216 reaches the trailing edge of slot 208. Roller 216 rotates onto the end of pawl 230 and forces it back out of slot 208, which also causes push rod 222 to retract. When the roller rotates around to the leading edge of slot 208, it begins dragging cam 100 along with it and concentric rotation is resumed.

The cone assembly shown in FIGS. 6 and 7 may require a number of other components for proper operation, such as thrust washers (not shown) to provide bearing surfaces upon which cam 100 and cone 104, respectively, can rotate, a spacer 240 between cam coupler plate 204 and pawl engagement plate 206, and one or more seals 242 to retain lubricants and exclude borehole fluids.

One advantage of the cone assembly described above is its energy efficiency. Electrical power conservation is usually critical in a borehole drilling system, as the downhole electronics are frequently battery powered. Replacing spent batteries requires removing the drill string from the borehole, which is costly and time consuming. The described system is arranged such that digging in a preferential direction requires solenoid actuation signals of short duration, with the mechanical forces inherently present at the bottom of the hole powering the system the rest of the time.

Figure 8:
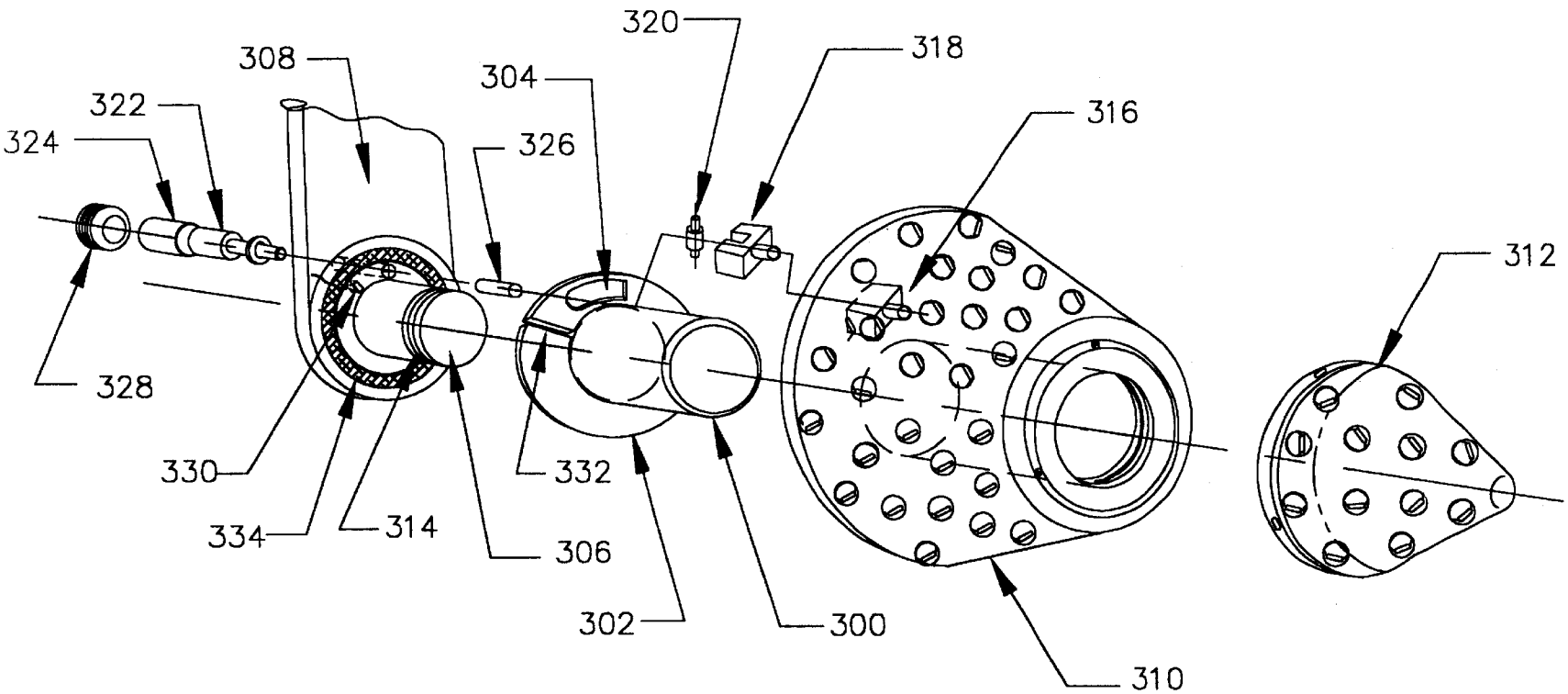
FIG. 8 is an exploded view of another possible embodiment of a controllable drill bit per the present invention.
Figure 9:
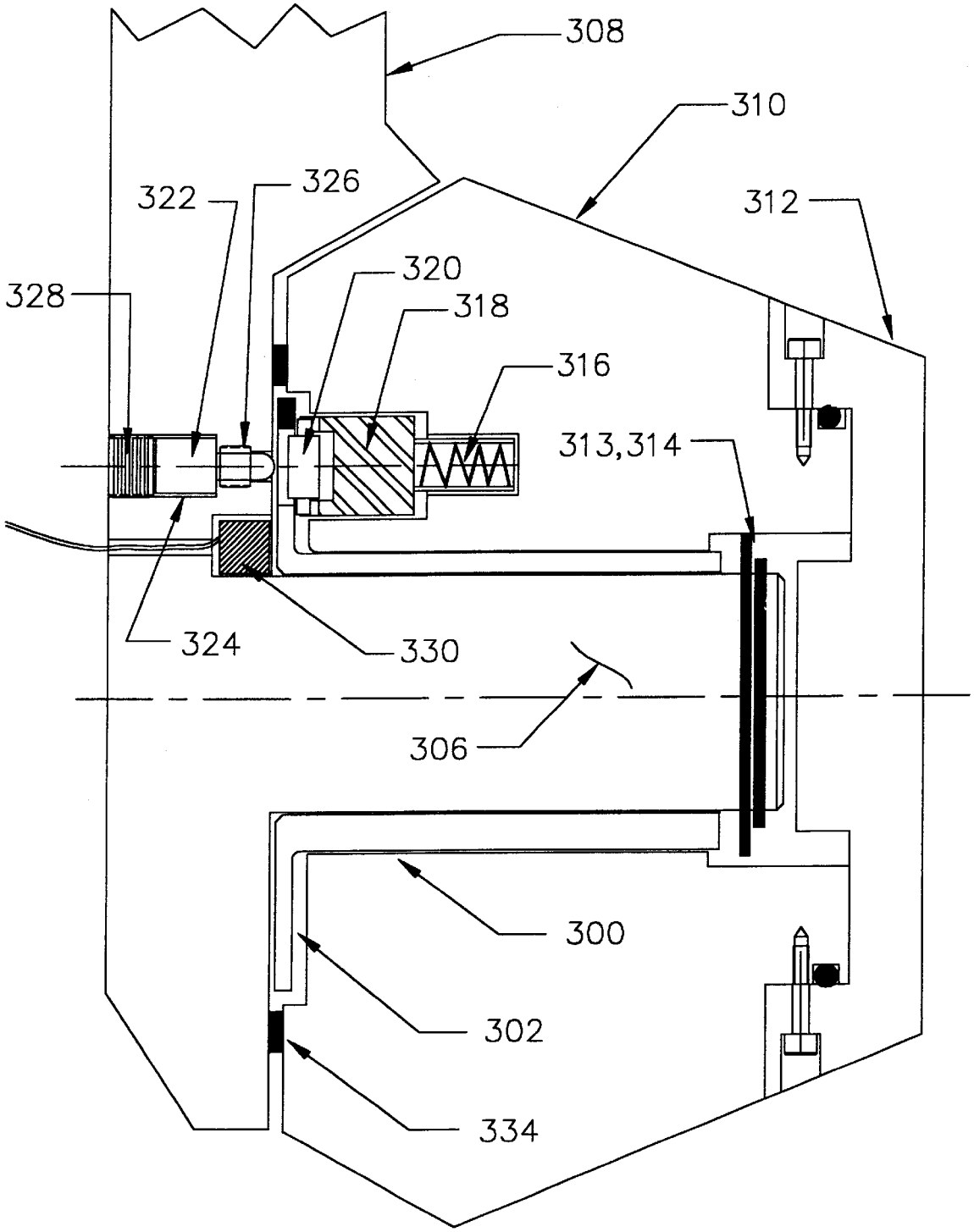
FIG. 9 is a sectional view of the controllable drill bit shown in FIG. 8.

Another possible embodiment of a cam/cone assembly as might be used in a controllable drill bit per the present invention is shown in FIGS. 8 and 9, which are exploded and sectional views of the assembly, respectively. Here, eccentric cam 300 is attached at one end to a circular cam coupler plate 302, which includes a semi-circular pawl engagement slot 304 nears its outer diameter. Cam 300 and coupler plate 302 are mounted on an axle 306 which extends from one leg 308 of the drill bit.

A cone 310 is mounted to a cap 312; the cone fits over cam 300 and axle 306 and is held in place with, for example, a retaining ring 313 (not shown in FIG. 8) that fits into a corresponding groove 314 on axle 306. A coil spring 316 is attached to the inside of cone 310, and a roller carrier 318 which supports a cam carrier/pawl reset roller 320 is mounted on the spring. The carrier and roller are positioned such that roller 320 aligns with slot 304.

The assembly also includes a solenoid 322 mounted within a sleeve 324, which is in turn mounted through an opening in leg 308 outside of axle 306; the solenoid extends a pawl 326 in response to a command signal. A plug 328 preferably fills one end of the sleeve to prevent contamination of the solenoid, bearing surfaces, and other components. When solenoid 322 is actuated, pawl 326 is pushed into semi-circular slot 304, such that, when the pawl contacts the trailing edge of the slot, cam 300 is locked to axle 306. Cone 310, however, continues to rotate with the drill bit, due to the weight bearing upon the bit by the drill string. The continued rotation of cone 310 forces roller 320 to climb out of now-stationary slot 304, which in turn forces the cone to rotate about the locked eccentric cam. This results in the cone rotating eccentrically about axle 306.

When cone 310 is to rotate concentrically, solenoid 322 is de-actuated, pawl 326 is retracted, and roller 320 is in slot 304. Spring 316 applies enough pressure on roller 320 to cause cam 300 to be dragged along with cone 310 as the cone rotates. In this way, cam and cone are locked together as a unit which rotates concentrically about axle 306.

As with the assembly of FIGS. 6–7, solenoid 322 need only be actuated until pawl 326 comes into contact with the trailing edge of slot 304 (which would typically occur within several milliseconds), after which mechanical forces hold the pawl in the slot. Once solenoid 322 is no longer needed, it is de-actuated, which allows pawl 326 to retract when pushed by roller 320. As the cone/cap/spring/roller assembly completes one eccentric rotation around the locked cam 300, the roller 320 reaches the trailing edge of slot 304. Roller 320 rotates onto the end of pawl 326 and forces it back out of slot 304. When the roller rotates around to the leading edge of slot 304, it begins dragging cam 300 along with it and concentric rotation is resumed.

Each assembly preferably includes an angular position sensor 330 which pulses its CAP output when an index notch 332 in cam coupler plate 302 rotates past the sensor's position.

The assembly shown in FIGS. 8 and 9 may require a number of other components for proper operation, such as thrust washers (not shown) to provide bearing surfaces upon which cam 100 and cone 104, respectively, can rotate, and one or more seals 334 to retain lubricants and exclude borehole fluids.

The cone assemblies shown in FIGS. 6–9 are merely exemplary; many other designs could be used to provide a drill bit which includes one or more drilling surfaces which are positionable in response to a command signal. In addition, a number of design variations might be employed with the cone assembly shown; for example, for the assembly of FIGS. 6–7, a retractable solenoid having its push rod coupled to pawl 230 might be used to back the pawl out of slot 208, rather than relying on the pressure of roller 216.

While particular embodiments of the invention have been shown and described, numerous variations and alternate embodiments will occur to those skilled in the art. Accordingly, it is intended that the invention be limited only in terms of the appended claims.

I claim:

1. A directional borehole drilling system, comprising:

at least one sonde for mounting within a drill string which is coupled to a controllable drill bit that includes one or more drilling surfaces that are dynamically positionable in response to respective command signals, said drill bit having associated present position, toolface angle, and angular position parameters, said at least one sonde comprising:

a storage medium which contains information that represents a desired drill bit trajectory, instrumentation which determines the present position of said bit when said bit is in a static position, instrumentation which determines said bit's dynamic toolface angle when said bit is rotating, and instrumentation which determines the dynamic angular positions of said positionable drilling surfaces when said bit is rotating, and a processor which receives said present position, dynamic toolface, and dynamic angular position information from said instrumentation, determines the error between said present position and said desired trajectory, and provides said command signals to said controllable drill bit such that said drill bit bores in the direction necessary to reduce said error.

2. The borehole drilling system of claim 1, further comprising said controllable drill bit, said drill bit comprising:

a plurality of cone assemblies mounted about a central axis, each of which rotates about a respective axle and thereby drills a borehole when said bit is driven to rotate about said central axis, and at least one mechanism coupled to respective ones of said cone assemblies which is actuated in response to a respective one of said command signals, said at least one mechanism arranged to force its respective cone assembly to rotate eccentrically about its axle when actuated, and to allow its respective cone assembly to rotate concentrically about its axle when not actuated.

3. The borehole drilling system of claim 2, wherein said controllable drill bit comprises three cone assemblies mounted about said central axis and three of said mechanisms coupled to respective ones of said cone assemblies.

4. The borehole drilling system of claim 2, wherein each of said mechanisms comprises:

an eccentric cam which rotates about the axle of said mechanism's respective cone assembly and is positioned between said cone assembly's axle and said cone assembly, a means for locking said cam to said cone assembly such that, when said cam is locked to said cone assembly, said cam and said cone assembly rotate together about said axle concentrically, and a means for locking said cam to said axle such that, when said cam is locked to said axle, said cone assembly rotates about said axle eccentrically.

5. The borehole drilling system of claim 4, wherein said means for locking said cam to said axle comprises an extendible pawl coupled at one end to said axle, which, when extended, mechanically couples said cam to said axle.

6. The borehole drilling system of claim 5, further comprising a solenoid which extends said pawl to couple said cam to said axle when actuated in response to a respective one of said command signals.

7. The borehole drilling system of claim 6, wherein said means for locking said cam to said cone assembly comprises a spring which rotates with said cone assembly, said spring arranged to force said pawl to retract to uncouple said cam from said axle and to couple said cone assembly to said cam.

8. The borehole drilling system of claim 4, wherein said instrumentation which determines the dynamic bit toolface angle comprises a plurality of flux-gate magnetometers contained within said sonde and said instrumentation which determines the dynamic drilling surface position comprises a plurality of angular position sensors positioned near respective cams.

9. The borehole drilling system of claim 4, wherein said instrumentation which determines the dynamic bit toolface angle comprises a plurality of accelerometers which are filtered with respective rate gyros and said instrumentation which determines the dynamic drilling surface position comprises a plurality of angular position sensors positioned near respective cams.

10. The borehole drilling system of claim 4, wherein said instrumentation which determines the dynamic bit toolface angle comprises a plurality of flux-gate magnetometers and said instrumentation which determines the and dynamic drilling surface position comprises a plurality of optical encoders positioned near respective cams.

11. The borehole drilling system of claim 4, wherein said controllable drill bit and said each of said cone assemblies have respective circumferences, said controllable drill bit and said cone assemblies arranged such that the ratio of said drill bit circumference to the circumference of any of said cone assemblies is or approaches an irrational number.

12. The borehole drilling system of claim 1, wherein said instrumentation which determines present position comprises a plurality of accelerometers, a plurality of magnetometers, and a means for determining the length of pipe which has been added to said drill string since the previous determination of present position.

13. The borehole drilling system of claim 12, further comprising a transmitter located near the surface end of said drill string from which the length of pipe added to said drill string is transmitted to a receiver located near said controllable drill bit.

14. The borehole drilling system of claim 13, wherein said storage medium is coupled to said receiver and said desired drill bit trajectory information is conveyed to said storage medium via said transmitter and receiver.

15. The borehole drilling system of claim 1, wherein said desired drill bit trajectory is preloaded into said storage medium.

16. A directional borehole drilling system, comprising:

at least one sonde for mounting within a drill string which is coupled to a controllable drill bit that includes one or more drilling surfaces that are dynamically positionable in response to respective command signals, said drill bit having associated present position and toolface angle parameters, said at least one sonde comprising:

a storage medium which contains information that represents a desired drill bit trajectory, instrumentation which determines the present position of said bit when said bit is in a static position, and the bit's dynamic toolface angle and the positions of said positionable drilling surfaces when said bit is rotating, a processor which receives said present position, dynamic toolface, and drilling surface position information from said instrumentation, determines the error between said present position and said desired trajectory, and provides said command signals to said controllable drill bit such that said drill bit bores in the direction necessary to reduce said error, a controllable drill bit, said drill bit comprising:

a plurality of cone assemblies mounted about a central axis, each of which rotates about a respective axle and thereby drills a borehole when said bit is driven to rotate about said central axis, and at least one mechanism coupled to respective ones of said cone assemblies which is actuated in response to a respective one of said command signals, said at least one mechanism arranged to force its respective cone assembly to rotate eccentrically about its axle when actuated, and to allow its respective cone assembly to rotate concentrically about its axle when not actuated, wherein each of said mechanisms comprises:

an eccentric cam which rotates about the axle of said mechanism's respective cone assembly and is positioned between said cone assembly's axle and said cone assembly, a means for locking said cam to said cone assembly such that, when said cam is locked to said cone assembly, said cam and said cone assembly rotate together about said axle concentrically, and a means for locking said cam to said axle such that, when said cam is locked to said axle, said cone assembly rotates about said axle eccentrically, wherein each of said mechanisms is arranged to lock its cone assembly to said cam after its cone assembly has completed one revolution about said axle with said cam locked to said axle.

17. A directional borehole drilling system, comprising:

at least one sonde for mounting within a drill string which is coupled to a controllable drill bit that includes one or more drilling surfaces that are dynamically positionable in response to respective command signals, said drill bit having associated present position and toolface angle parameters, said at least one sonde comprising:

a storage medium which contains information that represents a desired drill bit trajectory, instrumentation which determines the present position of said bit when said bit is in a static position, and the bit's dynamic toolface angle and the positions of said positionable drilling surfaces when said bit is rotating, a processor which receives said present position, dynamic toolface, and drilling surface position information from said instrumentation, determines the error between said present position and said desired trajectory, and provides said command signals to said controllable drill bit such that said drill bit bores in the direction necessary to reduce said error, a controllable drill bit, said drill bit comprising:

a plurality of cone assemblies mounted about a central axis, each of which rotates about a respective axle and thereby drills a borehole when said bit is driven to rotate about said central axis, and at least one mechanism coupled to respective ones of said cone assemblies which is actuated in response to a respective one of said command signals, said at least one mechanism arranged to force its respective cone assembly to rotate eccentrically about its axle when actuated, and to allow its respective cone assembly to rotate concentrically about its axle when not actuated, wherein each of said mechanisms comprises:

an eccentric cam which rotates about the axle of said mechanism's respective cone assembly and is positioned between said cone assembly's axle and said cone assembly, a means for locking said cam to said cone assembly such that, when said cam is locked to said cone assembly, said cam and said cone assembly rotate together about said axle concentrically, a means for locking said cam to said axle such that, when said cam is locked to said axle, said cone assembly rotates about said axle eccentrically, said means for locking said cam to said axle comprising an extendible pawl coupled at one end to said axle, which, when extended, mechanically couples said cam to said axle, a solenoid which extends said pawl to couple said cam to said axle when actuated in response to a respective one of said command signals, a spring which rotates with said cone assembly, said spring arranged to force said pawl to retract to uncouple said cam from said axle and to couple said cone assembly to said cam, and a roller affixed to said spring and a plate coupled to said cam, said plate including a semi-circular slot aligned with said roller, said solenoid arranged such that said pawl extends into said slot when said solenoid is actuated and stops said plate and thereby said cam from rotating, said spring and roller arranged such that, when said solenoid is not actuated, said roller forces said pawl out of said slot and catches the edge of said slot to lock said cam to said cone assembly as said roller rotates with said cone.

18. A directional borehole drilling system, comprising:

at least one sonde for mounting within s drill bit that includes one or more drilling surfaces that are dynamically positionable in response to respective command signals, said drill bit having associated present position and toolface angle parameters, said at least one sonde comprising:

a storage medium which contains information that represent a desired drill bit trajectory, instruments which determines the present position of the said bit when said bit is in a static position, and the bit's dynamic toolface angle and the position, of said positionable drilling surfaces when said bit is rotating a processor which receives said present position, dynamic toolface, and drilling surface position information from said instrumentation, determines the error between said present position and said desired trajectory, and provides said command signals to said controllable drill bit such that said drill bit bores in the direction necessary to reduce said error, a controllable drill bit, said drill bit comprising:

a plurality of cone assemblies mounted about a central axis, each of which rotates about a respective axle and thereby drills a borehole when said bit is driven to rotate about said central axis, and at least one mechanism coupled to respective to respective ones of said cone assemblies which is actuated in response to a respective one of said command signals, said at least one mechanism arranged to force its respective cone assembly to rotate eccentrically about its axle when actuated, and to allow its respective cone assembly to rotate concentrically about its axle when not actuated, where each of said mechanisms comprises:

an eccentric cam which rotates about the axle of said mechanism's respective cone assembly and is positioned between said cone assembly's axle and said cone assembly, a means for locking said cam to said cone assembly, said cam and said cone assembly rotate together about said axle concentrically, and a means for locking said cam to said axle such that, when said cam is locked axle, said cone assembly rotates about said axle eccentrically, wherein said instrumentation which determines dynamic bit toolface angle and drilling surface position comprises a plurality of synchros positioned near respective cams, and a plurality of magnetometers.

19. A directional borehole drilling system, comprising:

a controllable drill bit having associated present position, toolface angle, and angular position parameters, said bit comprising:

a plurality of cone assemblies mounted about a central axis, each of which rotates about a respective axle and thereby drills a borehole when said bit is driven to rotate about said central axis, at least one mechanism coupled to respective ones of said cone assemblies which is actuated in response to a respective command signal, said at least one mechanism arranged to force its respective cone assembly to rotate eccentrically about its axle when actuated and to allow its respective cone assembly to rotate concentrically about its axle when not actuated, a drill string coupled to said controllable drill bit, a driving means coupled to said drill string which drives said bit to rotate about said central axis, and at least one sonde within said drill string which comprises:

a storage medium which contains information that represents a desired drill bit trajectory, a first instrumentation package which determines the present position of said bit when said bit is in a static position, a second instrumentation package which determines the dynamic toolface angle of said bit when said bit is rotating, a third instrumentation package which determines the dynamic angular positions of the cone assemblies coupled to said mechanisms when said bit is rotating about said central axis, and a processor which receives said present position, dynamic toolface, and dynamic angular position information from said instrumentation, determines the error between said present position and said desired trajectory, and provides said command signals to said to said controllable drill bit such that said drill bit bores in the direction necessary to reduce said error.

20. A directional borehole drilling system, comprising:

a controllable drill bit, said bit comprising:

a plurality of cone assemblies mounted about a central axis, each of which rotates about a respective axle and thereby drills a borehole when said bit is driven to rotate about said central axis, at least one mechanism coupled to respective ones of said cone assemblies which is actuated in response to a respective command signal, said at least one mechanism arranged to force its respective cone assembly to rotate eccentrically about its axle when actuated and to allow its respective cone assembly to rotate concentrically about its axle when not actuated, a drill string coupled to said controllable drill bit, a driving means coupled to said drill string which drives said bit to rotate about said central axis, and at least one sonde within said drill string which comprises:

a storage medium which contains information that represents a desired drill bit trajectory, a first instrumentation package which determines the present position of said bit when said bit is in a static position, a second instrumentation package which determines the dynamic toolface angle of said bit and the positions of the cone assemblies coupled to said mechanisms when said bit is rotating about said central axis, and a processor which receives said present position and cone assembly position information from said instrumentation, determines the error between said present position and said desired trajectory, and provides said command signals to said to said controllable drill bit such that said drill bit bores in the direction necessary to reduce said error, wherein each of said mechanisms comprises:

an eccentric cam mounted on said axle, a spring and a roller coupled to and rotating with said cone assembly, a plate coupled to said cam which includes a semicircular slot aligned with said roller, and a solenoid affixed to said axle and arranged to extend a pawl into said slot when actuated to stop said plate and thereby said cam from rotating, said spring and roller arranged such that, when said solenoid is not actuated, said roller forces said pawl out of said slot and catches the edge of said slot to lock said cam to said cone assembly as said roller rotates with said cone.

21. A method of directional drilling in a bore-hole, comprising the steps of:

providing a controllable drill bit which comprises a plurality of cone assemblies mounted about a central axis, each of which rotates about a respective axle and can be made to rotate either concentrically or eccentrically about said axle, said drill bit having associated present position and toolface angle parameters and said cone assemblies having associated angular positions, determining a desired trajectory for said drill bit, determining the present position of said drill bit, determining the error between said present position and said desired trajectory, rotating said drill bit about said central axis, determining the dynamic toolface angle of said bit, determining the dynamic angular positions of said cone assemblies, and causing, based on said present position, said dynamic toolface angle, and said angular position data, at least one of said cone assemblies to rotate eccentrically about its axle such that drill bit bores in a direction necessary to reduce said error.

22. The method of claim 21, wherein said controllable drill bit includes respective mechanisms coupled to respective ones of said cone assemblies, each of said mechanisms comprising:

a cam which rotates about the axle of said mechanism's respective cone assembly and is positioned between said cone assembly's axle and said cone assembly, a means for locking said cam to said cone assembly such that, when said cam is locked to said cone assembly, said cam and said cone assembly rotate together about said axle concentrically, and a means for locking said cam to said axle such that, when said cam is locked to said axle, said cone assembly rotates about said axle eccentrically, each of said cone assemblies made to rotate concentrically by locking its cam to said cone assembly and made to rotate eccentrically by locking its cam to its axle.

23. A controllable drill bit which includes one or more drilling surfaces which are positionable in response to a command signal, said bit comprising:

a plurality of cone assemblies mounted about a central axis, each of said cone assemblies arranged to rotate about a respective axle as said bit is rotated about said central axis, a plurality of mechanisms coupled to respective ones of said cone assemblies, each of which is actuated in response to a respective command signal, each mechanism arranged to force its respective cone assembly to rotate eccentrically about its axle when actuated and to allow its respective cone assembly to rotate concentrically about its axle when not actuated, each of said mechanisms comprising:

an eccentric cam mounted on said axle, a spring and a roller coupled to and rotating with said cone assembly, a circular plate coupled to said cam which includes a semi-circular slot aligned with said roller, and a solenoid affixed to said axle and arranged to extend a pawl into said slot when said mechanism is actuated to stop said plate and thereby said cam from rotating, said spring and roller arranged such that, when said mechanism is not actuated, said roller forces said pawl out of said slot and catches the edge of said slot to lock said cam to said cone assembly as said roller rotates with said cone.

24. The controllable drill bit of claim 23, wherein said axle is cylindrical and has a longitudinal axis which runs down its center, said solenoid mounted within said axle and aligned along said longitudinal axis, further comprising a lever which is fixed at one end and movable at its other end and arranged to be pushed at its center when said mechanism is actuated, said pawl mounted to said movable end of said lever such that it moves along an axis parallel to but offset from said longitudinal axis when extended.

25. The controllable drill bit of claim 23, wherein the diameter of said plate is greater than that of said cam and said semi-circular slot is located outside the outer diameter of said cam, said solenoid mounted outside the outer diameter of said axle.

26. The controllable drill bit of claim 23, further comprising a plurality of angular position sensors mounted to respective axles, each of said cams having an index notch aligned to rotate past a respective one of said sensors to indicate its angular position.

27. The controllable drill bit of claim 23, further comprising a plurality of optical encoders mounted to respective axles and arranged to indicate the angular positions of respective cams.

28. A controllable drill bit which includes one or more drilling surfaces which are positionable in response to a command signal, said bit comprising:

a plurality of cone assemblies mounted about a central axis, each of said cone assemblies arranged to rotate about a respective cylindrical axle as said bit is rotated about said central axis, a plurality of mechanisms coupled to respective ones of said cone assemblies, each of which is actuated in response to a respective command signal, each mechanism arranged to force its respective cone assembly to rotate eccentrically about its axle when actuated and to allow its respective cone assembly to rotate concentrically about its axle when not actuated, each of said mechanisms comprising:

an eccentric cam mounted on said axle, a spring and a roller coupled to and rotating with said cone assembly, a circular plate coupled to said cam which includes a semi-circular slot near its outer diameter which is aligned with said roller, a solenoid mounted within said axle and aligned along its longitudinal axis and which is actuated when said mechanism is actuated, a lever which is fixed at one end and movable at its other end and arranged to be pushed at its center when said solenoid is actuated, and a pawl which is mounted to said movable end of said lever such that it is extended along an axis parallel to but offset from said longitudinal axis when said solenoid is actuated, said pawl further arranged to extend into said slot when actuated to stop said plate and thereby said cam from rotating, said spring and roller arranged such that, when said solenoid is not actuated, said roller forces said pawl out of said slot and catches the edge of said slot to lock said cam to said cone assembly as said roller rotates with said cone.

29. A controllable drill bit which includes one or more drilling surfaces which are positionable in response to a command signal, said bit comprising:

a plurality of cone assemblies mounted about a central axis, each of said cone assemblies arranged to rotate about a respective cylindrical axle as said bit is rotated about said central axis, a plurality of mechanisms coupled to respective ones of said cone assemblies, each of which is actuated in response to a respective command signal, each mechanism arranged to force its respective cone assembly to rotate eccentrically about its axle when actuated and to allow its respective cone assembly to rotate concentrically about its axle when not actuated, each of said mechanisms comprising:

an eccentric cam mounted on said axle, a spring and a roller coupled to and rotating with said cone assembly, a circular plate coupled to said cam which includes a semi-circular slot near its outer diameter which is aligned with said roller, a solenoid mounted outside said axle which is actuated when said mechanism is actuated, and a pawl which is extended into said slot when said solenoid is actuated to stop said plate and thereby said cam from rotating, said spring and roller arranged such that, when said solenoid is not actuated, said roller forces said pawl out of said slot and catches the edge of said slot to lock said cam to said cone assembly as said roller rotates with said cone.

* * * * *